US008607471B2

(12) United States Patent
Bae et al.

(10) Patent No.: US 8,607,471 B2
(45) Date of Patent: Dec. 17, 2013

(54) METHOD FOR OPERATING CLOTHES DRYER HAVING LIQUID INJECTION MEANS

(75) Inventors: Sanghun Bae, Gyeongsangnam-Do (KR); Minji Kim, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 370 days.

(21) Appl. No.: 12/846,233

(22) Filed: Jul. 29, 2010

(65) Prior Publication Data

US 2011/0047811 A1 Mar. 3, 2011

Related U.S. Application Data

(60) Provisional application No. 61/213,952, filed on Jul. 31, 2009.

(30) Foreign Application Priority Data

Jul. 31, 2009 (KR) ..... 10-2009-0070957

(51) Int. Cl.
*F26B 7/00* (2006.01)

(52) U.S. Cl.
USPC ..... 34/427; 34/524; 68/20; 8/159

(58) Field of Classification Search
USPC ..... 34/413, 427, 497, 524, 527; 68/5 R, 68/18 R, 19, 20; 8/137, 159
See application file for complete search history.

(56) References Cited

U.S. PATENT DOCUMENTS

| | | | | |
|---|---|---|---|---|
| 2,706,346 | A * | 4/1955 | Smith | 34/75 |
| 4,204,339 | A * | 5/1980 | Muller | 34/75 |
| 5,219,371 | A * | 6/1993 | Shim et al. | 8/149.1 |
| 5,396,715 | A * | 3/1995 | Smith | 34/261 |
| 7,882,647 | B2 * | 2/2011 | Ikemizu | 34/524 |
| 8,286,364 | B2 * | 10/2012 | Bae et al. | 34/60 |
| 2008/0307667 | A1 * | 12/2008 | Ikemizu | 34/132 |
| 2011/0047811 | A1 * | 3/2011 | Bae et al. | 34/427 |

FOREIGN PATENT DOCUMENTS

| | | |
|---|---|---|
| CN | 101381936 | 3/2009 |

* cited by examiner

*Primary Examiner* — Steve M Gravini
(74) *Attorney, Agent, or Firm* — McKenna Long & Aldridge LLP

(57) ABSTRACT

Disclosed is a method for operating a clothes dryer, the dryer including a drum rotatably installed within a cabinet, a blow fan configured to supply air into the drum, a heater configured to heat air, and a liquid injection means configured to inject liquid into the drum, the method including a drying step of supplying hot air heated by the heater into the drum to dry clothes, a preprocessing step of cooling the inside of the drum with supplying air in a turn-off state of the heater, and a liquid injection step of injecting the liquid into the drum after performing the preprocessing step, wherein the liquid injection step is repeatedly performed in plural times, whereby the liquid can be injected into clothes after the preprocessing step, so as to allow an effective deposition of the liquid onto the clothes.

8 Claims, 4 Drawing Sheets

METHOD FOR OPERATING CLOTHES DRYER HAVING LIQUID INJECTION MEANS

CROSS-REFERENCE TO RELATED APPLICATION

Pursuant to 35 U.S.C. §119(a), this application claims the benefit of earlier filing date and right of priority to Korean Application No. 10-2009-0070957, filed on Jul. 31, 2009, and U.S. Patent Application No. 61/213,952 filed on Jul. 31, 2009, the contents of which is incorporated by reference herein in its entirety.

BACKGROUND OF THE INVENTION

1. Field of the Invention

The present invention relates to a method for operating a clothes dryer having a liquid injecting means into a drum, and particularly, to a method for spraying liquid via a liquid injection means in a clothes dryer having a liquid injection means.

2. Background of the Invention In general, a clothes dryer is a device for inputting the laundry in a spin-dry-terminated state after washing is completed into the interior of a drum and supplying hot wind into the drum to evaporate moisture of the laundry to thus dry the laundry.

The clothes dryer includes a drum into which the laundry is input, a driving motor for driving the drum, a blow fan for blowing air into the interior of the drum, and a heating unit for heating air introduced into the interior of the drum. The heating unit may use high temperature electric resistance heat generated by using an electric resistance or combustion heat generated by combusting (burning) gas.

Air discharged from the drum in the clothes dryer contains moisture of the laundry placed within the drum, so the air includes much moisture and has a high temperature. In this case, the dryer may be classified into according to how the air with much moisture at a high temperature is processed. Namely, the driver may be classified into a condense type drier in which air with high temperature and high moisture is circulated, rather than being discharged to the outside, to be heat exchanged with external air in a condenser to condense the moisture contained in the air with the high temperature and high moisture, and an exhaust type dryer in which air with the high temperature and high moisture, which has passed through the drum, is directly discharged outwardly.

However, as users take different lift styles, demands on clothes dryers having various functions in addition to the drying function increase. For instance, the tendency is to release clothes dryers having various functions for maintaining and preserving the laundry as well as drying the same, such as removing wrinkles on the laundry using a rotational force of the drum in the clothes dryer and separate additives, spraying fragrance, handling static electricity and the like.

In addition, clothes dryers for adding fragrance to the laundry by supplying a material with a specific fragrance upon drying the laundry have been introduced. In the clothes dryers, the odor of the laundry which may remain in the laundry after being dried is removed and new fragrance is added to the laundry.

To this end, a clothes dryer having an injection nozzle through which a fragrance liquid is injected into the drum has been produced; however, since the strength of fragrance and an amount of a fragrance material consumed depend on how to inject fragrance, an injection module control method for controlling fragrance to be effectively deposited onto the clothes has been required.

SUMMARY OF THE INVENTION

Therefore, to solve the problems of the related art, an object of the present invention is to provide a method for operating a clothes dryer capable of efficiently spraying liquid via an injection nozzle, through which the liquid is injected into a drum of the dryer.

To achieve these and other advantages and in accordance with the purpose of the present invention, as embodied and broadly described herein, there is provided a method for operating a clothes dryer, the dryer including a drum rotatably installed within a cabinet, a blow fan configured to supply air into the drum, a heater configured to heat air, and a liquid injection means configured to inject liquid into the drum, the method including a drying step of supplying hot air heated by the heater into the drum, a preprocessing step of cooling the inside of the drum, and a liquid injection step of injecting the liquid into the drum, wherein the liquid injection step is repeatedly performed in plural times with a preset interval.

The drum may rotate during the liquid injection step.

The method may further include a unit drying step of supplying hot air into the drum after each of the liquid injection steps.

The heater and the blow fan may not operate during the liquid injection step.

The method may further include a droplet settling step of maintaining a turn-off state of the heater and the blow fan between the liquid injection step and the unit drying step.

A time for which the liquid injection step is performed may be decided based upon an amount of clothes input and an intensity of the liquid selected.

The method may further include a post-processing step of cooling the inside of the drum after completion of the liquid injection step.

A temperature of hot air during the unit drying step may be set to be lower than a temperature of hot air during the drying step.

In accordance with the aspects of the present invention having the configuration, an amount of liquid to be used for adding fragrance can be reduced.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of a configuration of a clothes dryer and an operation method using a liquid injection means in accordance with the preferred embodiments of the present invention, with reference to the accompanying drawings.

Figure 1:
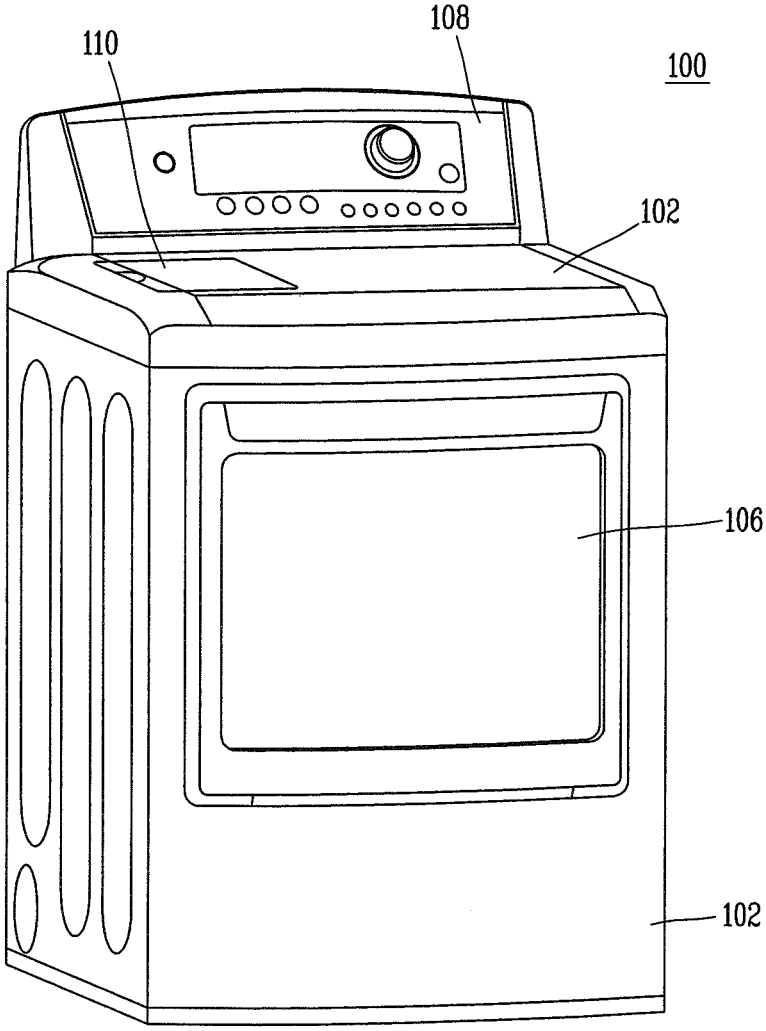
FIG. 1 is a perspective view of a clothes dryer in accordance with one embodiment of the present invention.
Figure 2:
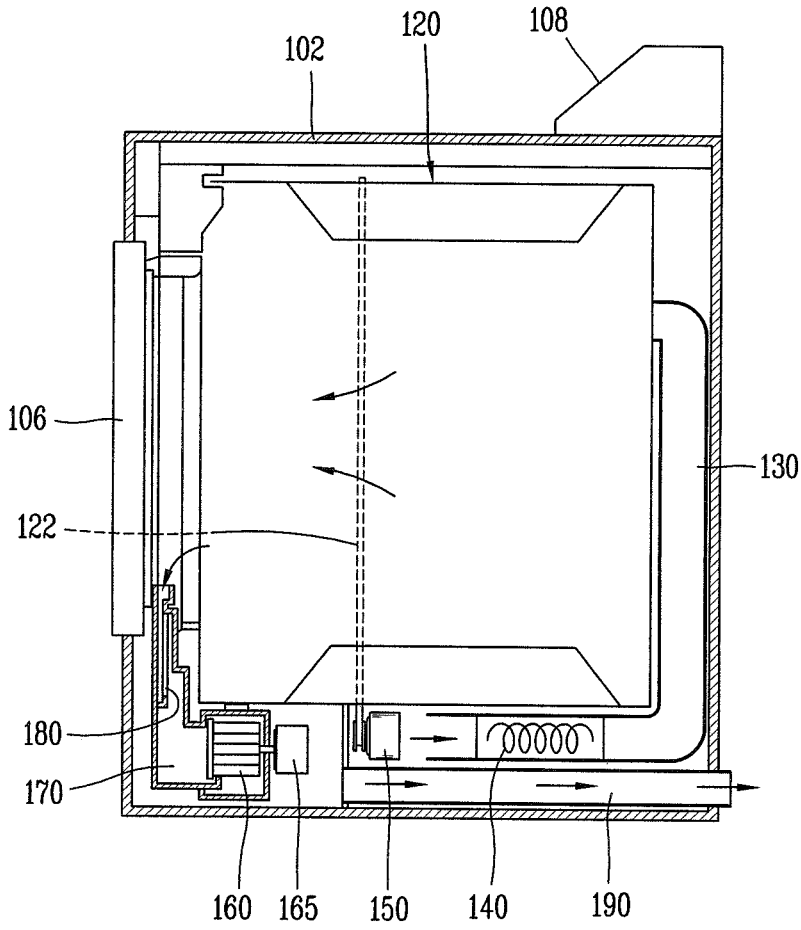
FIG. 2 is a longitudinal sectional view showing an interior of the clothes dryer of FIG. 1.

FIG. 1 is a perspective view schematically showing a clothes dryer in accordance with one embodiment of the present invention, and FIG. 2 is a sectional view showing schematically showing an internal structure of FIG. 1.

As shown in FIGS. 1 and 2, a dryer 100 may include a cabinet defining an outer appearance of the device, and the front surface of the cabinet is shown having an opening open and closed by a door 106 for inputting the laundry to be dried thereinto. A manipulation panel 108 having various manipulation buttons for manipulating the dryer 100 may be present on a rear side of an upper surface of the dryer. Here, the present invention may not be limited only to the dryer, but be applicable to any clothes processing device having a drying function, for instance, a washing machine having the drying function or the like.

Meanwhile, a cartridge mounting unit 110 is disposed at an upper surface 102 of a dryer main body, and a cartridge (not shown) containing liquid may be replaceably mounted in the cartridge mounting unit 110. The liquid stored in the cartridge may be injected into a drum in a form of mist. The stored liquid may be water or a fragrance liquid which is a material having fragrance in a liquid state. The fragrance liquid mostly consists of water and is a mixture in which a fragrance undiluted solution is mixed at the preset rate. The liquid stored in the cartridge may be supplied to a nozzle disposed at a rear surface of the drum so as to be injected into the drum via the nozzle. For this, a pump for pressing the flowing liquid may be provided between the cartridge and the nozzle. If the liquid stored in the cartridge is water, the water is sprayed into the drum, and if the liquid is a fragrance solution, the fragrance solution is injected into the drum.

The dryer 110, as a clothes treating apparatus according to the present invention, may include a drum 120 rotatably installed in the cabinet for drying the laundry therein. The drum 120 may be rotatably supported by supporters at front and rear sides. In addition, the drum 120 may be connected to a driving motor 150 disposed at a lower side of the dryer so as to receive a rotational force. An inlet duct 130 may be installed at the rear side of the drum 120, and a heater 140 for heating an introduced air may be installed at an inlet side of the inlet duct 130. The front lower side of the drum 120 is shown, having a filter 180 for filtering out foreign materials, such as lint or the like, included in air discharged out of the drum 120, and ducts 170 and 190 for completely discharging the foreign material-filtered air to the exterior.

The ducts 170 and 190 may include a blow fan 160 for sucking up air within the drum 120 to forcibly blow out of the dryer, and a fan motor 165 for driving the blow fan 160. The present invention is characterized by a two-motor system separately having the driving motor 150 for driving the drum 120, and the fan motor 165 for driving the blow fan 160, so the two motors can be independently controlled. Consequently, the present invention may have an advantage of independently rotating the drum 120 and the blow fan 160. In other words, in the two-motor system, only the rotation of the drum 120 other than that of the blow fan 160 is allowed while a liquid is injected, accordingly, the liquid can be injected in a state that no air flows within the drum 120, thereby enabling a more effective deposition of the liquid into the laundry.

* The duct 190 may be installed such that one end communicates with an exterior of the cabinet 100, thereby serving to induce air forcibly blown by the blow fan 160 to the outside of the dryer. The blow fan 160 shown in the embodiment is a pull type blow fan which is disposed at a duct for exhausting air from a drum so as to suck air discharged from the drum towards an exhaust duct. However, depending on the configuration of the dryer, a blow fan may be configured to be disposed within the inlet duct 130** so as to push the heated air within the inlet duct into the drum, which is called a push type blow fan.

Figure 3:
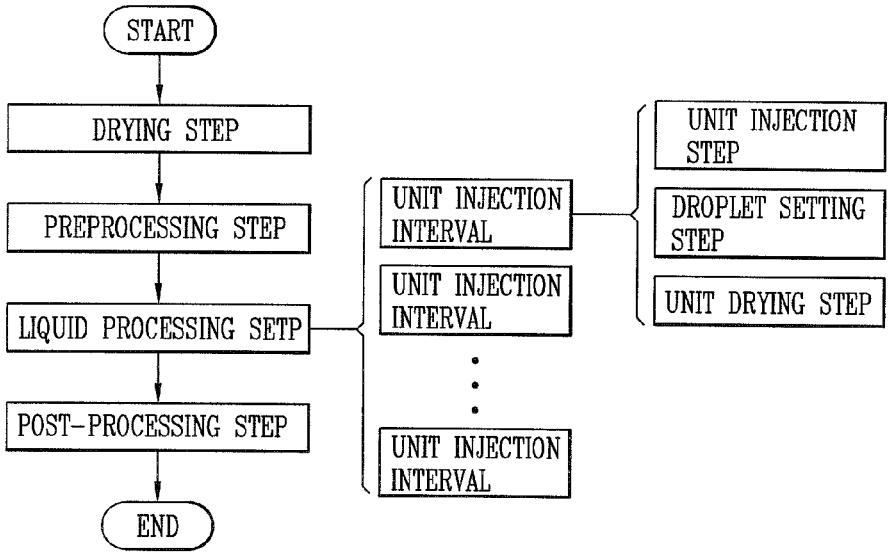
FIG. 3 is a flowchart showing a method for operating a clothes dryer in accordance with one embodiment of the present invention.

Hereinafter, a method for supplying liquid into the drum in the clothes dryer using the aforesaid liquid injection means will be described. FIG. 3 is a flowchart showing a method for operating a clothes dryer in accordance with one embodiment of the present invention, FIG. 4 is a view showing a cooperative relation among components at each step of the method for operating the clothes dryer in accordance with the one embodiment of the present invention, and FIG. 5 is an enlarged view of part A of FIG. 4.

Figure 4:
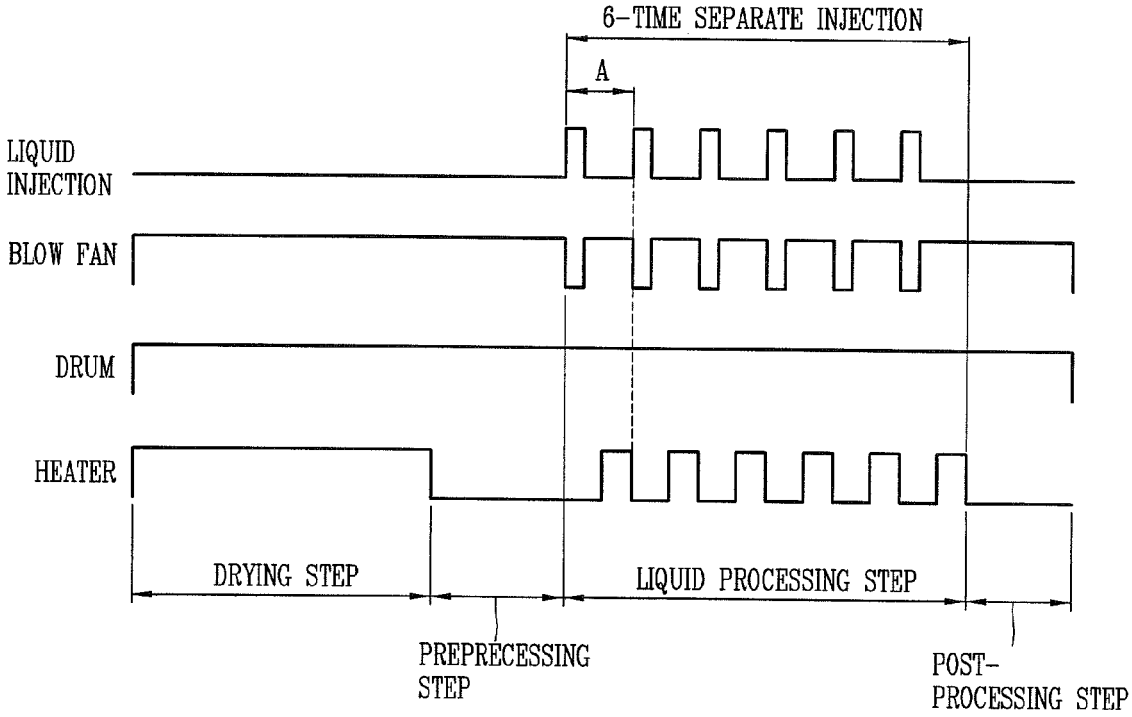
FIG. 4 is a view showing a cooperative relation among components at each step of the method for operating the clothes dryer in accordance with the one embodiment of the present invention.
Figure 5:
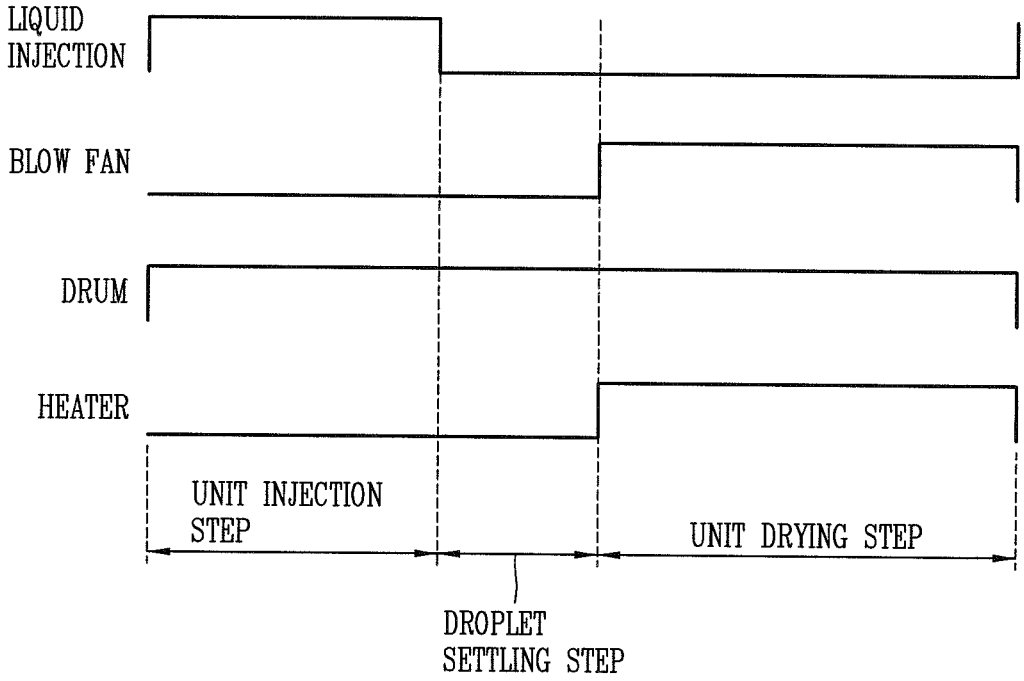
FIG. 5 is an enlarged view of part A of FIG. 4.

Referring to FIG. 4, an injection method for injecting liquid into the drum by controlling the liquid injection means according to the present invention may roughly be divided into a preprocessing step, a liquid injection step and a post-processing step. The liquid injection step is performed to inject water or a fragrance liquid contained in the cartridge into the drum, which will be described hereinafter.

The preprocessing step is to urge the liquid soaked through into the laundry and make the laundry fresh. In the clothes dryer according to the present invention, supplying liquid into the drum is related but not limited to injecting liquid after the completely washed and dehydrated laundry is dried within the dryer. The liquid supplying process according to the present invention may also be performed before a user takes and wears clothes which have been kept long in a clothes chest. The clothes which have been kept long in the clothes chest may be wrinkled and soaked up unpleasant smell within the chest. Thus, in order to remove the wrinkles and bad smell, the liquid supplying process may be carried out. In addition, if the preprocessing step is executed before supplying liquid, the clothes may be soaked, so it is allowed to deposit the liquid on the clothes better at the later liquid injection step.

Furthermore, at the preprocessing step, hot air heated by a heater may be supplied into the drum, and upon the supply of the hot air, the texture of the clothes becomes more flexible so that the fresh effect can be enhanced more. When such hot air is supplied, a cooling process for lowering an internal temperature of the drum should be performed before going into the liquid injection step. If a liquid is injected onto the clothes in a state that a temperature within the drum or a temperature of the clothes is high, the liquid may immediately be evaporated to be gone without being deposited on the clothes, accordingly, the intensity of the liquid deposited on the clothes may be lowered.

The liquid injection step is a process of pumping water or a fragrance liquid contained in the aforesaid liquid injection means, and injecting the liquid into the drum via the nozzle to be soaked through into the clothes. The liquid injection means may be configured to press the liquid stored in a storage tub or a chamber by a preset pressure using a pump so as to inject the liquid into the drum via the nozzle.

A user may be able to adjust the liquid to be injected as much as the user wants to. Hereinafter, an exemplary case where the liquid stored in the cartridge is a fragrance liquid will be described.

A fragrance intensity, as an intensity that a user feels fragrance deposited on clothes, may be variously set according to the user's requirements. A selection button may be provided on a control panel such that the user can select a desired intensity via a key input unit. Then, a controller of the dryer may control the liquid injection means such that the liquid injection means can inject a liquid with a fragrance intensity corresponding to the button selected by the user. For instance, if the intensity levels of fragrance selectable by the user are displayed on the control panel by being divided into 'high, medium, low,' when the user selects the high button, a long time is set for which fragrance is injected via the liquid injection means, thereby increasing the fragrance intensity. That is, when the user selects a high intensity of a fragrance intensity adjusting unit, the time for operating the pump of the liquid injection means may be controlled to be longer so as to urge more fragrance injected, thereby adjusting the intensity.

Hereinafter, description will be given of a method for operating a clothes dryer, in which a plurality of liquid injection steps are performed and a drying operation is followed for each liquid injection step.

A method for operating a clothes dryer according to the present invention may include a drying step of inputting clothes to be dried into the drum and supplying hot air therein for drying, and the aforesaid preprocessing step. That is, at the preprocessing step, air is supplied in a turn-off state of a heater so as to cool the inside of the drum. After performing the preprocessing step, a liquid injection step of injecting a liquid into the drum via the liquid injection means is performed. The liquid injection step may be configured to intermittently inject the liquid with a preset interval, other than injecting the liquid consecutively. FIG. 4 shows that one repeated step is indicated by "A" and FIG. 5 shows the one step in more detail, which will be separately described later.

Also, the present invention may employ a fan motor for driving a blow fan independent of a driving motor for driving a drum, so as to control the drum and the blow fan separately. The drum of the clothes dryer according to the present invention may be maintained in a rotating state by virtue of the driving motor throughout all the processes. Accordingly, the drum continuously rotates during the liquid injection step so as to stir the clothes input within the drum. However, the fan motor for driving the blow fan may be independently switched on or off if necessary.

The number of performing the liquid injection step may preferably be set but not limited to 6 times. In addition, the liquid injection step is followed by a unit drying step of drying the liquid injected during the liquid injection step.

Referring to FIG. 5, the liquid injection step is a process in which a liquid is injected into the drum by operating only the pump of the liquid injection means in a state that the heater and the blow fan are turned off. Hence, the blow fan can be turned off while the liquid is injected, thereby preventing the loss of the liquid injected. Also, the heater can be turned off to prevent the loss due to heat. Here, the driving motor is turned on to rotate the drum during the liquid injection, which allows the liquid to be uniformly deposited on the clothes, thereby enhancing the uniformity.

The unit drying step is a process in which after the liquid injection step, the heater and the blow fan are turned on to supply hot air into the drum to thereby dry moisture contained in the clothes due to the liquid injected during the liquid injection step. That is, since most of ingredients of the injected liquid are moisture, the moisture deposited on the clothes due to the liquid injection should be dried. However, if the unit drying process is performed too long, the injected and deposited liquid may be lost. Hence, the drying operation should be performed for an appropriate time, and a time for about 30 seconds is proper, which is obtained through a test.

Also, a droplet settling step for settling droplets of the injected liquid may further be performed between the liquid injection step and the unit drying step. The droplet settling step is performed such that only the driving motor is driven to rotate the drum in a state that the heater and the blow fan are turned off to stop supplying air into the drum. The droplet settling step is a process in which the droplets of the liquid injected during the liquid injection step float in the air within the drum, and then are deposited on the clothes, which are stirred by the rotation of the drum. It is noticed from a test that the floating droplets are settled, namely, deposited on the clothes after about 2 seconds elapse. Thus, upon undergoing the droplet settling step, it is possible to prevent the floating droplets from being lost outside the drum during the unit drying step, and also to allow the droplets to be uniformly deposited on the clothes.

Regarding the time for which the liquid injection step is performed, since the amount or intensity of the liquid, which was directly injected and deposited on the clothes, is decided at the liquid injection step, the time for which the liquid injection step is performed is decided based upon a laundry weight or an intensity of the liquid selected by the user. If the laundry weight input in the drum of the dryer is heavy or the user selects a high intensity of the liquid, the liquid injection step is allowed to be performed longer. As aforesaid, the droplet settling step may preferably be performed for 2 seconds and the unit drying step may preferably be performed for 30 seconds.

As described above, the present invention may include the liquid injection process of intermittently injecting liquid and a process of drying the injected liquid, thereby preventing the clothes from remaining in a wet state due to the liquid injection and reducing an amount of the liquid used.

After completion of the liquid injection step, a post-processing step for cooling the inside of the drum by rotating the drum and the blow fan in a turn-off state of the heater is performed.

The post-processing step is a process in which after the completion of the liquid injection step of injecting the liquid, a cooling operation for driving the blow fan with turning off the heater to supply air into the drum is performed for a preset period of time. This step may be performed in order to urge the liquid adhered to the clothes via the cooling operation, without being evaporated therefrom, after completion of the liquid injection. Also, the post-processing step may function to evenly dry the clothes and cool the drum to a temperature as appropriate as taking the clothes out of the dryer. In addition, in order to make the liquid evenly deposited on the clothes, the drum may preferably continuously rotate during the post-processing step.

A temperature of hot air during the unit drying step may preferably be lower than a temperature of hot air during a drying step at the beginning of the operation of the dryer. That is because the drying step is performed for the washing-completed clothes containing much moisture, whereas the unit drying step is performed for drying the liquid injected via the nozzle so as to dry a relatively small amount of moisture. Preferably, a driving voltage applied to the fan motor is constant, an increase rate of the rotation speed of the fan motor is in an inverse proportion to the amount of clothes input into the drum, and the maximum rotation speed of the fan motor during the drying step is in an inverse proportion to the amount of clothes input into the drum.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A method for operating a clothes dryer, the dryer comprising a drum rotatably installed within a cabinet, a blow fan configured to supply air into the drum, a heater configured to heat air into the drum, and a liquid injection means configured to inject liquid into the drum, the method comprising:

a drying step of supplying hot air heated by the heater into the drum;

a preprocessing step of cooling the inside of the drum by supplying air in a turn-off state of the heater; and a liquid injection step of injecting the liquid into the drum, wherein the liquid injection step is repeatedly performed in plural times with a preset interval.

2. The method of claim 1, wherein the drum rotates during the liquid injection step.

3. The method of claim 1, further comprising a unit drying step of supplying hot air into the drum after each of the liquid injection steps.

4. The method of claim 3, wherein the heater and the blow fan do not operate during the liquid injection step.

5. The method of claim 3, wherein a droplet settling step in which the heater and the blow fan remain turned off is performed between the liquid injection step and the unit drying step.

6. The method of claim 5, wherein a time for which the liquid injection step is performed is decided based upon an amount of clothes input and an intensity of liquid selected.

7. The method of claim 1, further comprising a post-processing step of cooling the inside of the drum after completion of the liquid injection step.

8. The method of claim 3, wherein a temperature of hot air during the unit drying step is lower than a temperature of hot air during the drying step.

* * * * *